United States Patent [19]

McClellan et al.

[11] Patent Number: 4,633,207

[45] Date of Patent: Dec. 30, 1986

[54] CAM FOLLOWING BRIDGE CONTACT CARRIER FOR A CURRENT LIMITING CIRCUIT BREAKER

[75] Inventors: David P. McClellan, Snellville, Ga.; John M. Brown, Westminster, Md.; Gustave E. Heberlein, Jr., Delafield, Wis.

[73] Assignee: Siemens Energy & Automation, Inc., Atlanta, Ga.

[21] Appl. No.: 718,692

[22] Filed: Apr. 1, 1985

[51] Int. Cl.[4] ..... H01H 75/00

[52] U.S. Cl. ..... 335/16

[58] Field of Search ..... 335/16, 147, 195; 200/147 R, 147 A, 147 B

[56] References Cited

U.S. PATENT DOCUMENTS

| | | | |
|---|---|---|---|
| 3,575,676 | 4/1971 | Beaudoin et al. | 335/16 |
| 3,575,680 | 4/1971 | Beaudoin et al. | 335/201 |
| 3,588,761 | 6/1971 | Heft et al. | 335/16 |
| 3,588,762 | 6/1971 | Willard | 335/16 |
| 3,991,391 | 11/1976 | Wafer | 335/16 |
| 4,001,738 | 1/1977 | Terracol et al. | 335/16 |
| 4,118,681 | 10/1978 | Nebon et al. | 335/195 |
| 4,132,968 | 1/1979 | Lang | 335/16 |
| 4,409,573 | 10/1983 | DiMarco et al. | 335/16 |
| 4,458,224 | 7/1984 | Kralik et al. | 335/16 |

FOREIGN PATENT DOCUMENTS

| | | | |
|---|---|---|---|
| 4526954 | 7/1966 | Japan | 335/16 |

*Primary Examiner*—L. T. Hix
*Assistant Examiner*—Brian W. Brown
*Attorney, Agent, or Firm*—F. W. Powers; J. L. James

[57] ABSTRACT

A current limiting circuit breaker is provided which has a stationary contact assembly and a movable contact bridge. A contact carrier is connected to the contact bridge and biases the contact bridge toward the closed position. The downward biasing force on the contact bridge is mechanically reduced in response to a preselected amount of opening movement of the contact bridge.

13 Claims, 11 Drawing Figures

CAM FOLLOWING BRIDGE CONTACT CARRIER FOR A CURRENT LIMITING CIRCUIT BREAKER

CROSS-REFERENCE TO RELATED APPLICATIONS

This application is related to application Ser. No. 718,693 filed Apr. 1, 1985 "Current Limiting Circuit Breaker Stationary Contact Assembly With Integral Magnetic Activating Means", David P. McClellan, John M. Brown and Robert E. Black.

BACKGROUND OF THE INVENTION

The invention relates generally to a current limiting circuit breaker, and more particularly, to a bridge contact structure and operating means for the circuit breaker.

Circuit breakers are widely used to provide protection for electrical distribution systems against damage caused by overload or fault current conditions. Over the years, as the capacity of power sources increased, it became necessary to provide increased interrupting capability for circuit breakers to adequately protect an electrical distribution system. To provide this level of protection in an economical manner, current limiting circuit interrupters were developed to limit the amount of fault current to a level substantially below that which the current source was capable of supplying.

Typically, circuit breakers require a certain contact closing force to reduce resistance between the contacts and to reduce the resistance heating generated during normal closed circuit conditions in order to meet required temperature restrictions. This contact force is most commonly obtained by means of extension or compression springs attached to the contact arm or arranged to exert the force on the contact arm. The higher the current rating of the circuit breaker, generally the greater the required contact force. In a current limiting circuit breaker, the contact arms separate independently of other portions of the operating mechanism to produce the current limiting action and, in the process, stretch or compress the springs from their normal positions. The resistive force supplied by these springs during current limiting operation thus significantly reduces the acceleration of the contact arms and the degree of current limiting. This is especially true with high current circuit breaker ratings. Accordingly, it would be appreciated that it would be highly desireable to minimize the contact spring force in order to produce maximum acceleration of the contact arm during blow-off. At the same time, however, sufficient contact closing force during normal closed circuit conditions must be maintained to reduce resistance heating of the circuit breaker contacts.

U.S. Pat. No. 4,409,573, which issued on Oct. 11, 1983 to Bernard DiMarco and Andrew J. Kralik, discloses a circuit breaker with a current limiting feature provided. The current limiting contacts blow open in response to fault current and are latched in the open position. The breaker is then reset by use of the operating handle. While this breaker achieves a current limiting effect, a higher current rating can be achieved by using blow open contacts of the current limiting type in series with this breaker. This configuration is disclosed in U.S. Pat. No. 4,458,224, which issued on July 3, 1984 to Bernard DiMarco and Andrew J. Kralik. In this embodiment, current limiting blow open contacts are placed in series with the circuit breaker. The blow open contacts are configured to reclose automatically by the action of biasing springs which also function to give the required closed contact pressure. It is apparent that the blow open force is a function of the current magnitude and the length of the parallel conducting paths which create the blow open force. The blow open force in this configuration is thus limited by the physical requirements of the circuit breaker enclosure. Accordingly, it would be appreciated that it would be highly desirable to provide increased blow open force for more rapid separation of the contacts due to a fault without increasing the physical dimensions of the circuit breaker enclosure.

U.S. Pat. No. 3,991,391, which issued on Nov. 9, 1976 to John A. Wafer, and U.S. Pat. No. 4,132,968, which issued on Jan. 2, 1979 to Walter W. Lane, disclose a current limiting circuit breaker which has a slot motor magnetic drive device. In this construction, the threshold level of overload current which produces current limiting action is raised, while the degree of current limiting action during high overload currents is maintained by placing a thin saturable magnetic steel plate across the open end of the slot motor magnetic drive device. During over current conditions below the threshold value, the plate shunts most of the magnetic flux and prevents production of magnetodynamic force upon the contact arm. Above the threshold level, the over current generates magnetic flux sufficient to saturate the plate and force additional flux into the air gap where the flux interacts with the contact arm to drive the contact arm into the slot and produce current limiting action in a normal manner. This configuration changes the normal response to a low level fault which the normal circuit breaker mechanism can handle and thereby limits the over current response of the current limiting contacts. Accordingly, it will be appreciated that it would be highly desirable to have a current limiting circuit breaker which responds rapidly to low level as well as high level faults.

It is apparent that rapid opening of the contacts is essential to successful operation and longevity of the current limiting contacts. For a given current, the blow open forces can be effectively increased by lowering the closing force of the contacts which is not really desired because closing contact pressure must be retained or by increasing the magnetic field.

U.S. Pat. No. 4,001,738, which issued Jan. 4, 1977, to Claude Terracol and Pierre Schueller, discloses a circuit interrupter having an electromagnetic repulsion device. In this configuration, a circuit interrupter has a magnetic circuit energized by the current flowing through the interrupter and an induction plate that is movable with the movable contact of the interrupter. The abrupt rising of a fault current induces secondary currents in the induction plate which is located in the air gap of the magnetic circuit as long as the interrupter is in the closed circuit position. The secondary currents tend to expel the induction plate from the air gap thereby moving the movable contact vigorously away from the magnetic circuit. This increases the repulsing forces for a given current thereby ensuring fast opening operation. An alternate embodiment discloses contacts which form a two-loop current path. That is, a path in which current enters one conductor, flowing in a first direction, then flows through the movable contact in the opposite direction and then flows through the second stationary conductor in the first direction. This two-loop configuration effectively doubles the magnetic repulsion force. U.S. Pat. No. 4,118,681, which issued Oct. 3, 1978 to Jean Pierre Nebon and Robert Morel also discloses a circuit breaker having a two-loop blow off configuration. This patent also discloses a retarding member which is mechanically linked to the movable contact assembly to delay the reclosing of the contact and to prevent a reclosing before tripping of the circuit breaker. While the circuit breakers disclosed offer fast operation in response to a high level fault condition, there is still needed a circuit breaker which opens quickly and cleanly in response to a low level fault condition. Accordingly, it will be appreciated that it would be highly desirable to provide current limiting circuit breaker contacts which cleanly open in response to low level fault conditions. Ideally, such contacts will snap open.

It is an object of the present invention to provide a current limiting circuit breaker which limits the current to a preselected maximum value.

Another object of the present invention is to provide a current limiting circuit breaker which opens quickly and cleanly in response to a low level fault condition.

Yet another object of the present invention is to provide current limiting contacts which snap open in response to a low fault condition.

Still another object of the present invention is to mechanically reduce the biasing force on the contact bridge in response to a preselected amount of movement of the contact bridge.

SUMMARY OF THE INVENTION

Briefly stated, in accordance with one aspect of the invention, the foregoing objects are achieved by providing a current limiting circuit breaker which has a stationary contact assembly with dual contacts. The circuit breaker includes a contact bridge movable between an open position at which the contact bridge is spaced from the stationary contacts and a closed position at which the contact bridge and the stationary contacts are in abutting contact. A contact carrier is connected to the bridge and biases the contact bridge toward the closed position. The biasing force on the contact bridge is mechanically reduced in response to a preselected amount of movement of the contact bridge.

The contacts of the current limiting circuit breaker blow open in response to a high level fault condition. The contacts also open in response to a low level fault condition because the biasing force on the contact bridge is reduced in response to a preselected amount of movement of the contact bridge. This ensures quick, clean opening of the contacts in response to a low level fault condition.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF THE PREFERRED EMBODIMENTS

Figure 1:
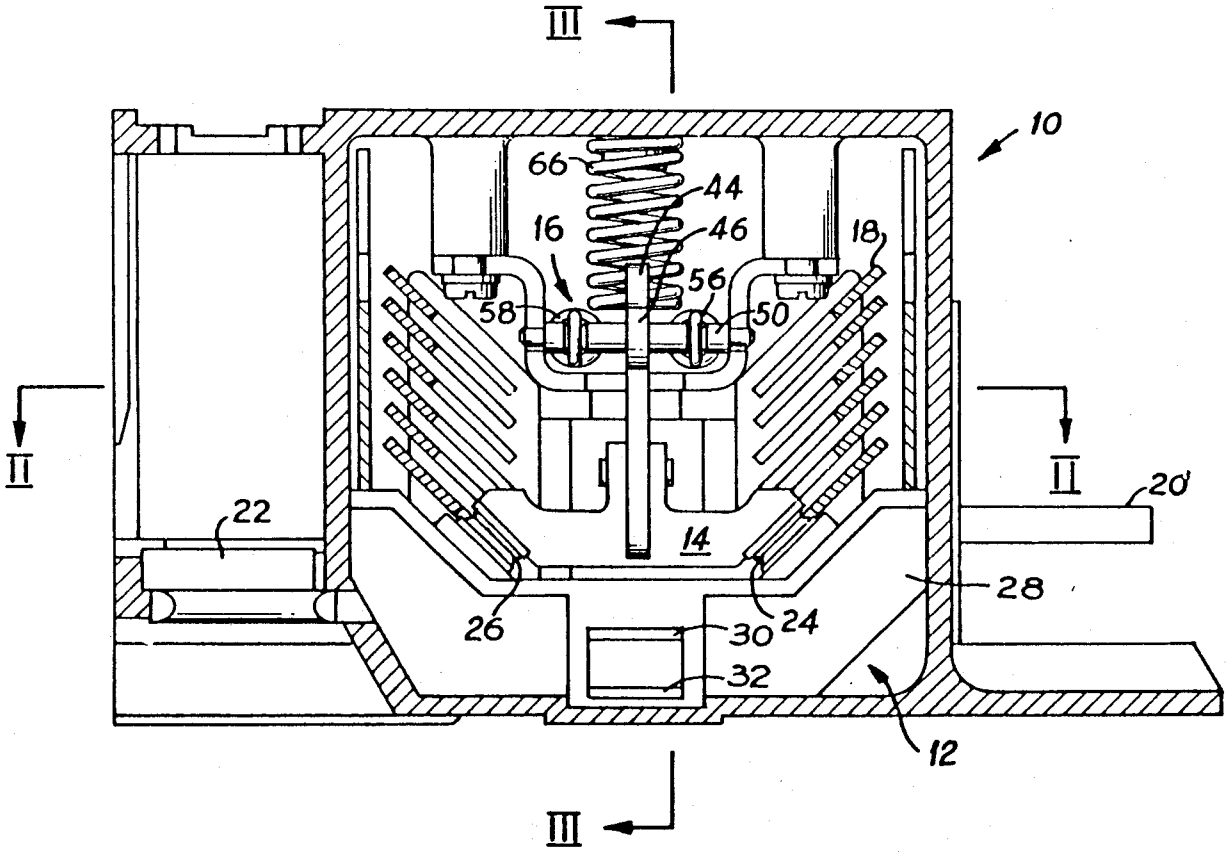
FIG. 1 is a diagrammatic view of the current limiting contacts of a current limiting circuit breaker assembly and is a longitudinal cross-sectional view of the circuit breaker.
Figure 2:
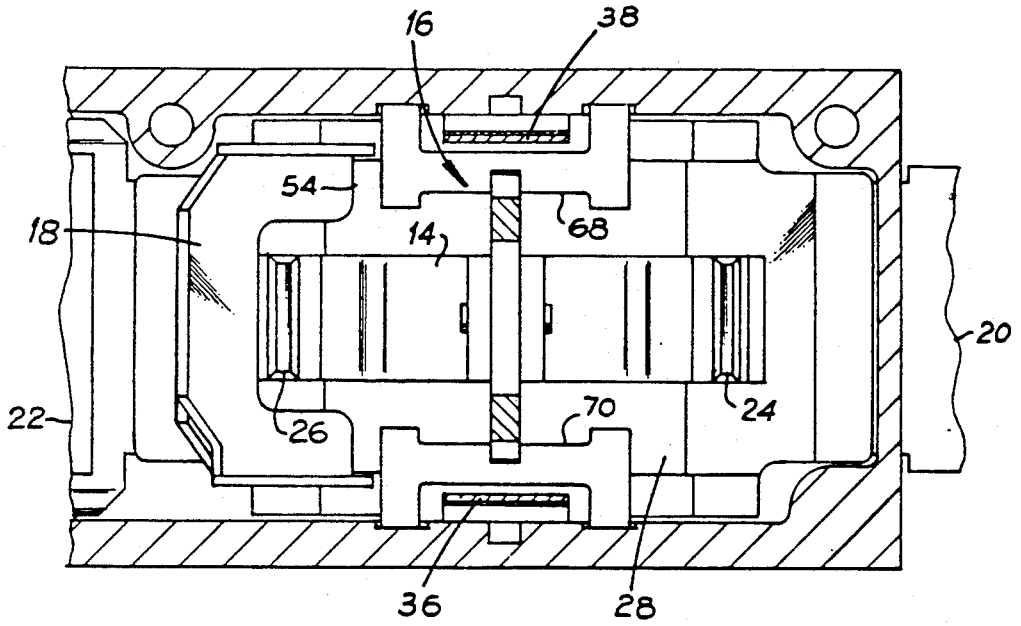
FIG. 2 is a longitudinal cross-sectional view generally taken along line II—II of FIG. 1 illustrating certain components which are described in detail in the specification.

Referring to FIG. 1, a current limiting circuit breaker 10 is shown which may be integrally formed with a circuit breaker or may comprise an add-on unit for an existing circuit breaker to increase the current interrupting rating of the circuit breaker. The current limiting circuit breaker 10 includes a stationary contact assembly 12, a movable contact bridge assembly 14 and a carrier assembly 16. An arc chute 18 is provided for quenching the arc as is well known in the art. The carrier assembly 16 exerts a closing force upon the contact bridge 14 which urges the movable and stationary contacts to the closed position at which the contacts abut one another. In response to a low level fault, the armatures 36 and 38 reduce the closing biasing force of the carrier assembly 16 on the contact bridge allowing the contacts to quickly and cleanly open in response to the low level fault. During a high level fault, the magnetic repulsion is sufficient to blow the contacts open. As the contacts open, the arc chute 18 draws out the arc and extinguishes the arc.

Referring to FIGS. 5–11, the stationary contact assembly 12 includes an input arm 20, an output arm 22, an input contact 24 attached to the end of the input arm 20, an output contact 26 attached to the end of the output arm 22. The input and output arms are encapsulated in an encapsulation material 28 which electrically insulates the contact arms one from the other. Also embedded in the encapsulation material is a first magnetic element 30 and a second magnetic element 32 which are insulated by the encapsulation material from each other and from each of the contact arms. The first magnetic element 30 is preferrably placed between the input and output contact arms and is centrally located so that it is between input and output contacts 24, 26 which are exposed for making proper contact with the bridge contact assembly 14. An edge or face of the magnetic element protrudes from the encapsulation material. Where the second magnetic element 32 is used, it is preferably located beneath the input contact arm 20. This places the second magnetic element at the bottom of the stationary contact structure 12.

Figure 8:
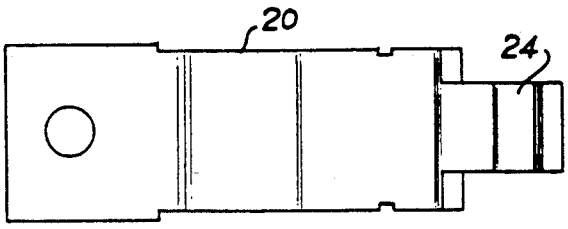
FIG. 8 is a top view of the input terminal of the stationary contact assembly.
Figure 9:
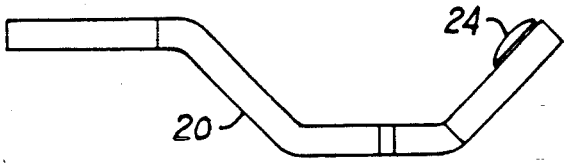
FIG. 9 is a side view of the stationary contact of FIG. 8.

Referring to FIGS. 8 and 9, the output contact arm 22 has an opening 34 of a size sufficient for receiving a portion of the input arm 20. The output contact 26 is affixed to one end of the contact arm 22 and the other end of the contact arm is configured for connection to the circuit breaker by means of flexible conductors or other means. The end of the output contact arm 22 which has the output contact 26 affixed thereon extends angularly upward from the contact arm. By this construction, the contact 26 is exposed when installed in the contact assembly 12 and surrounded by the encapsulation material 28.

Figure 10:
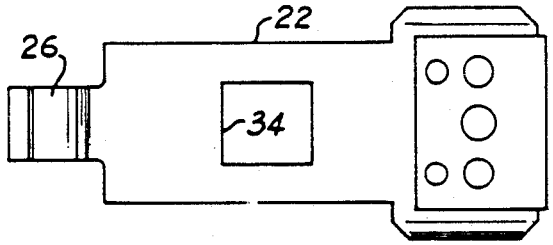
FIG. 10 is a top view of the output terminal of the stationary contact assembly.
Figure 11:
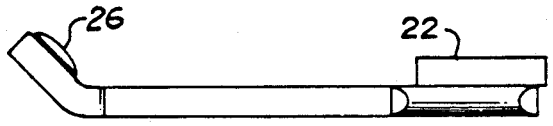
FIG. 11 is a side view of the stationary contact of FIG. 10.

Referring to FIGS. 10 and 11, the input arm 20 has the input contact 24 affixed to one end thereof. The other end of the contact arm is adapted for connection to an incoming line. The input contact arm is shaped from a flat piece of metal which has three bends therein. The first bend extends downward from the horizontal, the second bend returns the metal to the horizontal position and the third bend extends the metal angularly upward so that the contact 24 is approximately on the same horizontal plane as the terminal portion of the contact arm 20. The three bends divide the contact arm 20 into two portions, a horizontal terminal portion and a general U-shaped portion which has the contact 24 affixed to one leg of the U. The portion of the contact arm 20 which contains the contact 24 has a narrower configuration than the remainder of the contact. By this construction, the narrow portion of the contact arm 20 can be installed through the opening 34 of the output contact arm 22. This allows both contacts 24 and 26 to exist on the same horizontal plane. By this construction there is created a dual path wherein current entering the input arm 20 traverses the input arm to contact 24 and goes from contact 24 through the contact bridge assembly and returns through contact 26 to the output arm 22 and onto the main circuit breaker. The current flow in the input contact arm is to the right as viewed in the drawings and the current flow in the output contact arm 22 is also to the right while the current flow in the contact bridge is in the opposite direction. Therefore, the current in each of the arms produces a magnetic blow-off force. The combined blow-off force then is twice the normal blow-off force for a given current. As current flows through the contact arms 20 and 22, a magnetic field is created about the magnetic elements 30 and 32.

Figure 3:
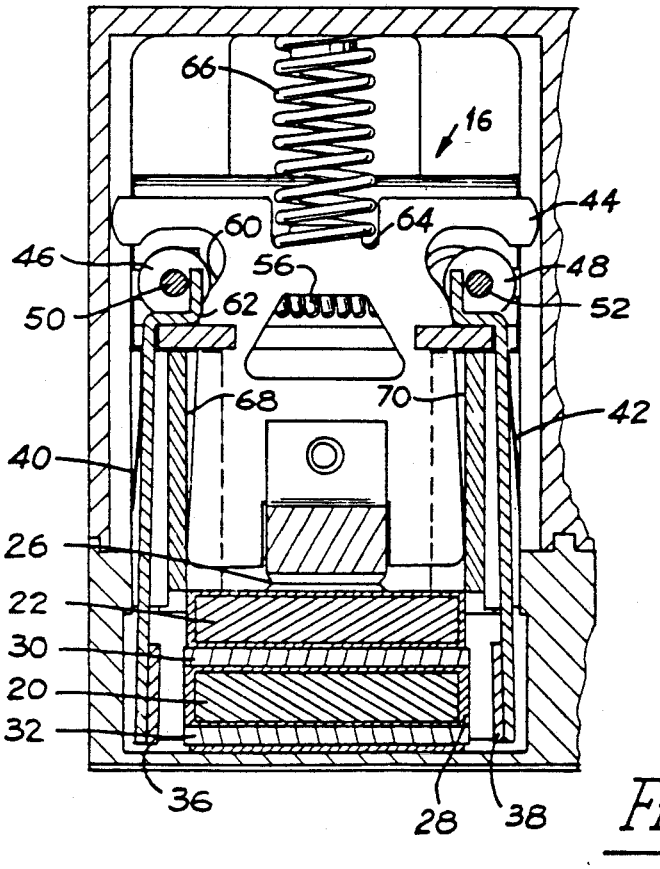
FIG. 3 is a diagrammatic view taken generally along line III—III of FIG. 1 illustrating other components which are described in detail in the specification.

Referring to FIG. 3, an armature assembly includes first and second armature arms 36, 38 which are connected on one end to the carrier assembly with the other end extending downwardly in the vicinity of the stationary contact assembly. Each armature arm 36, 38 has a leaf spring 40, 42 attached thereto for biasing the armature arms toward the stationary contact assembly. The free end of each armature arm extends to the vicinity of the magnetic elements 30, 32 of the stationary contact assembly 12. As previously mentioned, a magnetic field will exist about the magnetic elements during over current or fault conditions. This magnetic field attracts the free end of each armature toward the stationary contact assembly which, as will be explained more fully hereinbelow, reduces the closing contact force enabling the contacts to open more rapidly under low level fault conditions.

Figure 4:
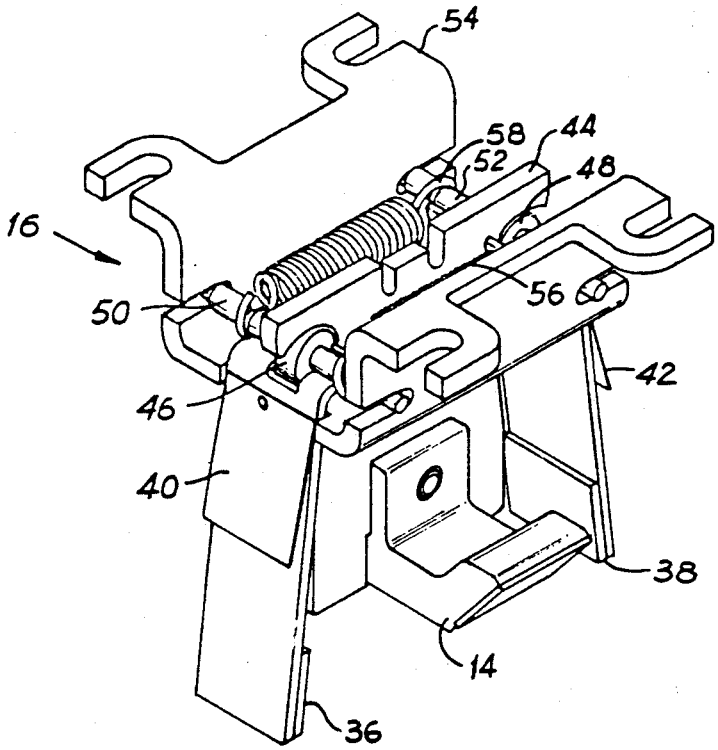
FIG. 4 is an isometric view of the contact carrier assembly.
Figure 5:
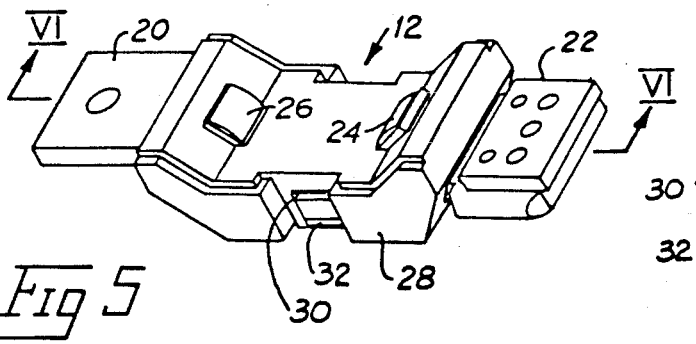
FIG. 5 is an isometric view of the stationary contact assembly.
Figure 7:
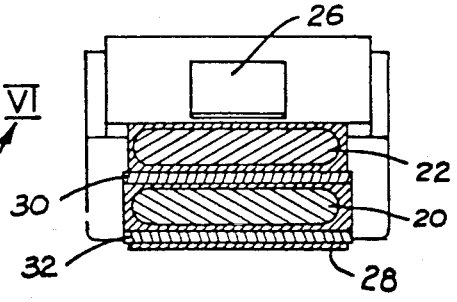
FIG. 7 is a cross-sectional view take along line VII—VII of FIG. 6.
Figure 6:
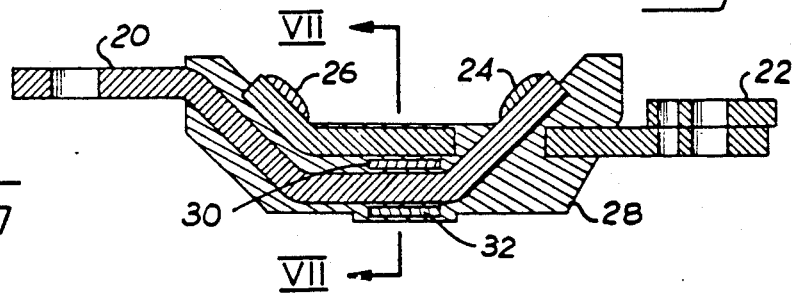
FIG. 6 is a longitudinal cross-sectional view of the stationary contact assembly taken along line VI—VI of FIG. 5.

Referring to FIGS. 3 and 4, the contact carrier assembly 16 includes the contact carrier 44 which rides on carrier rollers 46 and 48 which are respectively supported by shafts 50 and 52. Each end of the roller shafts is supported in a carrier frame 54 and the roller shafts are connected by roller springs 56, 58.

The carrier frame 54 is formed from a piece of steel which is shaped so that the central portion of the metal has a U-shaped configuration with feet extending from the legs of the U for anchoring the carrier frame to the housing. The carrier frame 54 has an opening in the bottom of the U-shaped portion of a size and configuration sufficient for receiving the contact carrier 44. The carrier frame 54 also has slots or other openings in the legs of the U-shaped portion of a size and configuration sufficient for receiving the ends of the roller shafts 50, 52. The roller springs 56, 58 are preferably coil springs which extend between the roller shafts 50, 52 and are anchored in grooves near the end portions thereof which leaves the center portion of the shaft which contains the carrier rollers 46, 48 free of interference with the roller springs 56, 58. The springs exert a force on the rollers which tends to pull the rollers toward one another. The openings in the carrier frame 54 in which the ends of the roller shafts are positioned allow for limited movement of the roller shafts toward one another in response to the force exerted by the springs.

The contact carrier 44 rides upon the carrier rollers 46, 48 and offers resistance to the force of the springs tending to pull the rollers toward one another. As shown, the contact carrier 44 has a first cam surface 60 and a second cam surface 62. In the preferred embodiment, the cam surfaces 60, 62 are inwardly sloped toward the longitudinal axis of the carrier 44 and the carrier rollers are displaced toward the carrier axis when the contacts are in the closed position as shown in the drawings. The carrier rollers are displaced in a direction away from the carrier axis when the contacts are in the open position. As mentioned, the contact carrier rides on the carrier roller. Looking at the left-hand cam surfaces and left-hand roller and roller shaft 46, 50, it is seen that the roller 46 engages the cam surfaces 60 in the closed position. In the open position, the carrier 44 is displaced vertically in the drawing and the carrier roller 46 engages the second cam surface 62. In the closed position, as the roller springs urge the carrier roller 46 against the first cam surface 60, the lateral force of the spring is converted into a vertical downward force because of the slope of cam surface 60. As the carrier 44 moves upward, it moves against the downward biasing force caused by the action of the spring on the roller 46 which creates a force because of the cam surface 60. This creates the closing biasing force for the contacts which ensures positive contact closure for minimizing resistance in the circuit breaker. As the carrier 44 moves up, the roller moves down the first camming surface 60 and approaches the junction of the first and second cam surfaces. When the roller engages the second cam surface 62, the downward force is abruptly decreased to a minimal value. The magnitude of the downward force while the roller 46 engages the second cam surface 62 is primarily determined by the slope of the cam surface. It is possible, for example, to have the slope of the second cam surface 62 vertical. One advantage of a non-vertical slope is that there is always a downward biasing force, so that once the fault is cleared or the contacts are opened, there is a force to return the carrier 44 to the closed position. Because of the difference in slope of the first cam surface 60 and the second cam surface 62, there is a sharp, abrupt decrease in the downward force at the junction of the first and second cam surfaces. Therefore, when the roller negotiates the corner, there is a sharp reduction in the force tending to keep the contacts closed and this release of downward force enables the contacts to snap open quickly, cleanly opening the contacts.

The contact carrier 44 may have a groove or notch 64 for engaging a return spring 66 which is positioned between the contact carrier 44 and the circuit breaker housing. The spring is optional and is useful for supplying a return force to the contact carrier to facilitate closing of the contact carrier once the contacts have opened in response to fault conditions. The spring provides a downward biasing force on the contact carrier and may be used to supplement the force exerted by the roller because of the second cam surface 62 or it may be used alone where the slope of the cam surface 62 is vertical. The spring ensures that the downward biasing force is present and is not affected by dirt, grit or other residue.

Each of the armature arms 36, 38 has its free end positioned in the area of the stationary contact assembly 12 and is attracted by the magnetic elements 30, 32 in response to fault currents. The left armature arm 36, and the right armature arm also, is formed of a piece of flat steel which is bent in two places forming a stepped configuration on one end. The free end of the armature may have an attachment thereon for better response to the magnetic field created by the magnetic inserts 30 and 32. Travelling from the free end of the armature arm up the armature arm, the first bend is encountered which directs the metal horizontally toward the center line of the carrier a short distance until the second bend is encountered which directs the metal upward in a vertical direction again. The upwardly extending portion of the armature arm has a notch or groove therein which forms the upwardly extending portion into a forked configuration. The forked configuration is positioned about the carrier roller so that one tine of the fork is positioned on each side of the carrier roller. The forked end is positioned between the carrier springs. This gives a structure then wherein the carrier roller 46 engages the first cam surface 60 of the carrier 44 and the armature is disposed with one tine of the fork beside the carrier roller toward the outside of the carrier assembly and the other tine is on the inside of the carrier roller. The configuration of the armature allows it to be positioned about the carrier shaft in a relationship with carrier frame 54 such that the armature arm 36 is firmly positioned yet is pivotally movable. The stepped portion of the armature arm partially wraps around the carrier shaft. By this construction, as the magnets 30, 32 attract the free end of the armature arm 36, the armature arm pivots thereby moving the carrier shaft outwardly against the force of the springs in a direction away from the center line of the carrier 44. As the carrier roller shaft 50 moves, the carrier roller 46 also moves and outward motion of carrier roller 46 relieves downward pressure on the cam surface 60 decreasing downward biasing pressure. The magnetic elements respond to low level fault conditions, thus the downward biasing force on the contact carrier is reduced in response to low level fault conditions so that the circuit may be interrupted at these low levels.

Referring to FIGS. 1–4, left and right spacer blocks 68, 70 are positioned within the housing. The spacer blocks 68, 70 are formed of a strong insulating material such as glass reinforced polyester, for example, and function to guide the contact carrier 44 in its opening and closing motion and to maintain separation between the magnetic structure 30, 32 and the armature arms 36, 38. The spacer blocks 68, 70 are identical but for ease of description only the left spacer block 68 will be described. The spacer block 68 has a general cross-section in the configuration of an "I" similar to the cross-section of an I-beam. The top and bottom rails of the I are identical but the vertical center rail of the I is displaced toward the right so that the space located between the top and bottom rails to the left of the vertical rail is greater than the space located between the top and bottom rails to the right of the vertical rail of the spacer block. Also, the right side of the center rail has a groove therein.

The spacer block 68 is positioned in the housing between the armature arm 36 and the contact carrier 44 so that the contact carrier 44 slides in the groove of the spacer block. Thus, the groove guides the contact carrier 44 during its motion up and down as it opens and closes. The armature arm 36 is positioned between the housing and the vertical rail of the I configuration between the top and bottom rails. This area might be thought of as a large groove which laterally positions the armature arm, and, more importantly, prevents the armature from contacting the magnetic elements 30 and 32. The spacer block 68 helps to maintain clearance between the armature arm 36 and the magnetic elements 30, 32 as well as guide the contact carrier 44 in its opening and closing motion. This is an important function since the contact carrier is constructed of a relatively thin flat piece of metal which can become cocked or skewed as it engages the rollers which would drastically change the opening and closing characteristics of the breaker. Thus, the block provides a means for guiding the contact carrier thereby increasing the accuracy of the circuit breaker.

Obviously, the force exerted by the spring tends to pull the carrier rollers toward the center line of the carrier assembly. Since the armature arm is engaged with the roller shafts, there is a force on the armature arm tending to pull the forked end of the armature arm toward the center of the carrier assembly. This force manifests itself by tending to pull the free end of the armature away from the magnets toward the armature housing. The armature spring 40 exerts a slight force on the armature arm tending to bias the arm toward the center line of the contact carrier. This armature spring compensates for differences in tolerances in the structure and ensures that the armature arm will be biased toward the magnetic structure. It will be noted that the circuit breaker can be economically manufactured because manufacturing tolerances are compensated for by the use of such things as the armature spring 40. Even if the surfaces of the carrier roller and roller shaft surfaces and the forked end of the armature were precision machined, there could still be some intolerance, perhaps because of dirt or grit, which could cause the free end of the armature arm to be displaced away from the magnetic structure more than is desired. Also, the armature arm could be displaced away from the magnetic structure without an undue force being exerted thereon, thus the armature spring compensates for these intolerances and biases the free end of the armature toward the magnetic structure so that the armature arms respond properly to low level fault conditions and eliminates unnecessary noise.

While operation of the preferred embodiments of the present invention are believed to be clearly apparent from the foregoing description, further amplification will be made in the following summary of such operation.

During normal operation, the circuit breaker is closed with the stationary contact assembly 12 and the bridge contact assembly 14 in contact with one another. Pressure applied to the contacts minimizes the contact resistance and thereby minimizes heating due to resistance as current flows through the contacts. This contact pressure is applied by roller springs 56, 58 which exert a force on the roller shafts 50, 52 and the rollers 46, 48 which in turn exert a force on the contact carrier 44 by acting upon the cam surface 60. This force maintains the required contact pressure to ensure minimal resistance heating. Normal current flows from the input arm 20 through the input arm contact 24 through the bridge contact assembly 14 through output contact 26 and to the output arm 22. This creates a current path in the encapsulated part of the stationary contact assembly 12 which flows in one direction. The current flow in the input arm and the current flow in the output arm is in the same direction. This creates twice the field effect for a given amount of current. The current flow through the contact bridge assembly 14 is in the opposite direction from the current flow in the stationary contact arms 20, 22. This creates an electromagnetic repulsing force which, at sufficient current levels, forces the movable contact bridge assembly 14 away from the stationary contact assembly 12.

As current flow through the breaker increases, the current flowing through the stationary contact assembly excites the magnetic elements 30, 32 which create a magnetic attractive force for the armature arms 36, 38. The magnetic elements and the gap between the magnetic elements and the armature are calculated such that the armature will begin to move toward the magnets at a preselected current level. Thus, as the current continues to rise to this level, the armatures are attracted toward the magnets.

As the current continues to rise and while the current is increasing, the armatures are attracted toward the magnets. As the free end of the armatures move in toward the magnets, the fixed end of the armatures are pivoted away from the center line of the carrier assembly against the force of the carrier springs. This reduces the downward biasing pressure on the carrier and thus on the movable contact bridge. This reduces the magnetic repulsive force required to separate the fixed and movable contacts. The armature arm mechanically reduces the force acting downwardly on the carrier, thereby enabling the contacts to open in response to a low level fault. As the armatures continue to move or as the current continues to rise, the carrier rollers will traverse the first cam surface 60 and approach the junction of the first and second cam surfaces 60, 62. As the carrier roller negotiates the junction between the two cam surfaces, the downward force on the contact carrier will be suddenly and drastically reduced enabling the contact bridge assembly to be quickly and cleanly separated from the stationary contact assembly by the magnetic repulsive forces mentioned earlier. Thus, the action of the armature is to mechanically reduce the force acting downwardly on the movable contact bridge assembly so that less magnetic repulsive force is required to blow open the contacts.

It may happen that instead of a low level fault, a high level fault may occur. In this instance, the magnetic repulsive force builds rapidly and literally blows the contacts open. It being understood that as the contacts blow open, once the carrier roller traverses the junction between the first cam surface and the second cam surface, that the contacts snap open quickly and cleanly regardless of the magnetic force applied. During a high level fault, the magnetic repulsive forces act very rapidly and, in fact, acts long before the magnetic attractive forces attract the armature. During this fast operation, the contact carrier 44 is guided in its upward and downward motion by the groove existing in the spacer blocks.

The current limiting circuit breaker automatically recloses. After the contacts open due to a low level fault or a high fault condition, the breaker is automatically reclosed by the combined action of the roller springs and the second cam surface. When the second cam surface has a non-vertical slope, there is always a slight downward force exerted on the contact carrier. This force is present when the contacts are open and the carrier roller rides on the second cam surface. This downward force exerted on the contact carrier urges the contacts toward the closed position. if there are no magnetic forces present to urge the contacts toward the open position, this downward force will exist until the corner at the junction of the first and second cam surfaces is negotiated at which point the downward pressure on the contact carrier will dramatically increase driving the contacts closed with the proper contact pressure. As mentioned earlier, an alternate embodiment of the present invention utilizes the return spring 66 to create a downward biasing force which urges the contacts toward the closed position. Either one of these methods alone is quite sufficient or they may both be used in combination.

As mentioned above, during a low level fault, the armatures are attracted and function to reduce the downward biasing pressure. In response to a high level fault, the circuit is opened before the armature is attracted by the magnetic elements. However, the armatures are attracted due to the brief current flow which creates a magnetic field even though the circuit is opened before the armatures have a chance to react. The armatures do react and reduce the downward biasing force exerted on the contact carrier by the carrier springs. This reduced downward pressure will exist until the attractive force for the armatures is removed. This force is a function of the magnitude of the fault current. Therefore, the higher the fault, the longer there will be an attractive force. This will prevent the breaker from closing before the fault disappears. As the effects of the fault subside, the armatures relax increasing the downward biasing force on the contact carrier and eventually the contacts will close. Again, once the carrier moves so that the carrier roller negotiates the junction between the first and second camming surfaces, the contacts snap closed again.

In one model of the invention, the main circuit breaker was designed for basic operation at 600 amperes. The interrupting rating for the current limiting contacts of the present invention was in excess of 100,000 amperes at 480 volts a.c. The bridge contact structure for interrupting this extremely high current is quite massive which hampers easy lift-off of the bridge contact assembly. Lift-off is hampered because the opening force must overcome the mass inertia of the large cross-section required at this current rating. For this model, the contacts would normally open at about 8,000 amperes for a low-level fault, but, the magnet structure functions to reduce this current level to about 6,000 amperes. The contacts open quickly in response to this reduction.

It will now be understood that there has been disclosed an improved current limiting circuit breaker which limits the current to a preselected maximum value and which opens quickly and cleanly in response to low level fault conditions. The current limiting contacts snap open smartly in response to a low fault condition. The armature assembly mechanically reduces the biasing force on the movable contact bridge in response to a preselected amount of movement of the contact bridge and facilitates the snap opening action of the circuit breaker. The current limiting contacts automatically reclose the reestablish the circuit after the fault condition is cleared eliminating damage to the contacts or malfunctions because of premature closing.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A current limitng circuit breaker comprising:
a stationary contact assembly having dual contacts; a contact bridge movable between an open position at which the contact bridge is spaced from the stationary contacts and a closed position at which the contact bridge and the stationary contacts are in abutting contact;
a moveable one-piece contact carrier having a cam surface with a predetermined slope and being connected to the contact bridge for biasing the contact bridge toward the closed position; and
means for mechanically reducing the biasing force on the contact bridge in response to a preselected amount of movement of the contact bridge , said means including a carrier roller and a spring engaging the carrier roller and urging the carrier roller against the cam surface of the contact carrier.

2. A current limiting circuit breaker according to claim 1, including means for providing snap-action opening in response to a low level fault.

3. A current limiting circuit breaker according to claim 1, wherein the contact carrier has a cam surface with a predetermined slope and including a carrier roller and a spring engaging the carrier roller and urging the carrier roller against the cam surface of the contact carrier.

4. A current limiting circuit breaker according to claim 3, wherein the contact carrier cam surface is inwardly sloped toward the longitudinal axis of the carrier whereby the carrier roller is displaced toward the carrier axis when the contacts are in the closed position and is displaced in a direction from the axis when contacts are open.

5. A current limiting circuit breaker according to claim 4, wherein the spring biases the roller against the carrier creating a closing force as the roller moves along a first portion of the cam surface, said force abruptly decreasing as the roller leaves the first portion of the cam surface and travels down a second portion of the cam surface.

6. A current limiting circuit breaker according to claim 5, wherein the bridge contacts snap open in response to an abrupt decrease in the closing force exerted by the rollers on the carrier.

7. A current limiting circuit breaker comprising:
a housing;
a stationary contact assembly having dual contacts;
a contact bridge movable between an open position at which the contact bridge is spaced from the stationary contacts and a closed position at which the contact bridge and the stationary contacts are in abutting contact;
a contact carrier connected to the contact bridge for biasing the contact bridge toward the closed position, said
contact carrier having first and second cam surfaces and a carrier roller which moves from the first cam surface to the second cam surface as the contact carrier moves from the closed position to the open position, said carrier roller moving along the first cam surface exerting a closing force thereon until the edge of the first cam surface is reached and then moving along the second cam surface, said carrier experiencing a sharp decrease in closing force in response to a preselected amount of movement of the contact bridge as the carrier roller traverses the junction between the first and second cam surfaces.

8. A current limiting circuit breaker according to claim 7, wherein the bridge contacts snap open in response to a sharp decrease in the closing force exerted on the carrier by the roller.

9. A current limitng circuit breaker comprising:
a stationary contact assembly having dual contacts;
a contact bridge moveable between an open position at which the contact bridge is spaced from the stationary contacts and a closed position at which the contact bridge and the stationary contacts are in abutting contact;
a contact carrier connected to the contact bridge for biasing the contact bridge toward the closed position;
means for mechanically reducing the biasing force on the contact bridge in response to a preselected amount of movement of the contact bridge; and
a roller and a spring engaging the roller and urging the roller against the carrier creating a closing force on the carrier as the roller moves along the carrier and a magnetic armature having one end abutting the carrier roller and the other end extending away from the carrier roller in a direction generally parallel to the carrier whereby as the end of the armature is attracted by the stationary contact assembly during opening the roller is urged away from the contact carrier thereby decreasing the closing force exerted on the carrier by the roller allowing the carrier to snap open the contacts.

10. A current limiting circuit breaker according to claim 9, including a spring attached to the armature for biasing the armature toward the stationary contact assembly.

11. A current limiting circuit breaker according to claim 10, including a spacer block positioned in the circuit breaker housing between the contact carrier and armature and having a groove for guiding the armature arm.

12. A current limiting circuit breaker according to claim 9, including a spacer block positioned in the circuit breaker housing between the contact carrier and armature and having a groove for guiding the contact carrier.

13. A current limiting circuit breaker comprising:
a housing;

a stationary contact assembly having dual contacts;

a contact bridge movable between an open position at which the contact bridge is spaced from the stationary contacts and a closed position at which the contact bridge and the stationary contacts are in abutting contact;

a contact carrier connected to the contact bridge for biasing the contact bridge toward the closed position;

means for mechanically reducing the biasing force on the contact bridge in response to a preselected amount of movement of the contact bridge; and a coil spring positioned in the circuit breaker housing and abutting the housing and the contact carrier for biasing the contact carrier toward the closed position.

* * * * *